US005921689A

United States Patent [19]

Buckby et al.

[11] Patent Number: 5,921,689

[45] Date of Patent: Jul. 13, 1999

[54] METHOD OF CALIBRATING A RIBBON WINDING MECHANISM FOR A PRINTING APPARATUS

[76] Inventors: Steven Buckby, 8 Denewood Avenue, Bramcote, Nottingham, NG9 3EU, United Kingdom; Keith Buxton, 17 Trafford Gardens, Aspley Lane, Nottingham, NG3 5AL, United Kingdom

[21] Appl. No.: 08/913,532

[22] Filed: Nov. 13, 1997

Related U.S. Application Data

[63] Continuation of application No. PCT/GB96/00649, Mar. 15, 1996.

[30] Foreign Application Priority Data

Mar. 15, 1995 [GB] United Kingdom ..... 9505216

[51] Int. Cl.[6] ..... B41J 33/14

[52] U.S. Cl. ..... 400/225; 400/232

[58] Field of Search ..... 400/207, 208, 400/223, 225, 232, 233, 226, 227, 227.1, 227.2

[56] References Cited

U.S. PATENT DOCUMENTS

| | | | |
|---|---|---|---|
| 4,969,761 | 11/1990 | Gibson-Saxty | 400/225 |
| 5,209,587 | 5/1993 | Herbert et al. | 400/225 |
| 5,433,539 | 7/1995 | German | 400/225 |
| 5,647,679 | 7/1997 | Green et al. | 400/232 |
| 5,700,096 | 12/1997 | Satoh et al. | 400/225 |

FOREIGN PATENT DOCUMENTS

| | | | |
|---|---|---|---|
| 27 42 974 | 3/1979 | Germany | 400/225 |
| 60-240480 | 11/1985 | Japan . | |
| 61-63473 | 4/1986 | Japan | 400/225 |
| 61-199972 | 9/1986 | Japan | 400/225 |
| 62-246773 | 10/1987 | Japan . | |

*Primary Examiner*—Christopher A. Bennett
*Attorney, Agent, or Firm*—Fish & Richardson P.C.

[57] ABSTRACT

A method of calibrating a ribbon winding mechanism of a printing apparatus which is adapted to perform a printing operation in which at a printing station a print head is moved relative to a first length of the ribbon to transfer print medium from the first length of the ribbon onto a substrate and the ribbon is subsequently advanced a predetermined amount to present a second length of ribbon at the printing station for use in a further printing operation, the winding mechanism comprising a supply spool and a take-up spool and there being a ribbon path between the supply and take-up spool through the printing station, and a motive means to cause the ribbon to be moved along the ribbon feed path and wound onto the take-up spool, and a sensing means to sense movement of the ribbon as the take-up spool is rotated and to provide a signal to a control means in response, the method being characterized in that prior to performing the printing operation, the take-up spool is rotated a predetermined amount whilst the sending means senses the resultant ribbon movement along the ribbon feed path and the control means determines from the signal received from the sensing means the amount to rotate the take-up spool in the subsequent printing operation to advance the ribbon the predetermined amount.

12 Claims, 1 Drawing Sheet

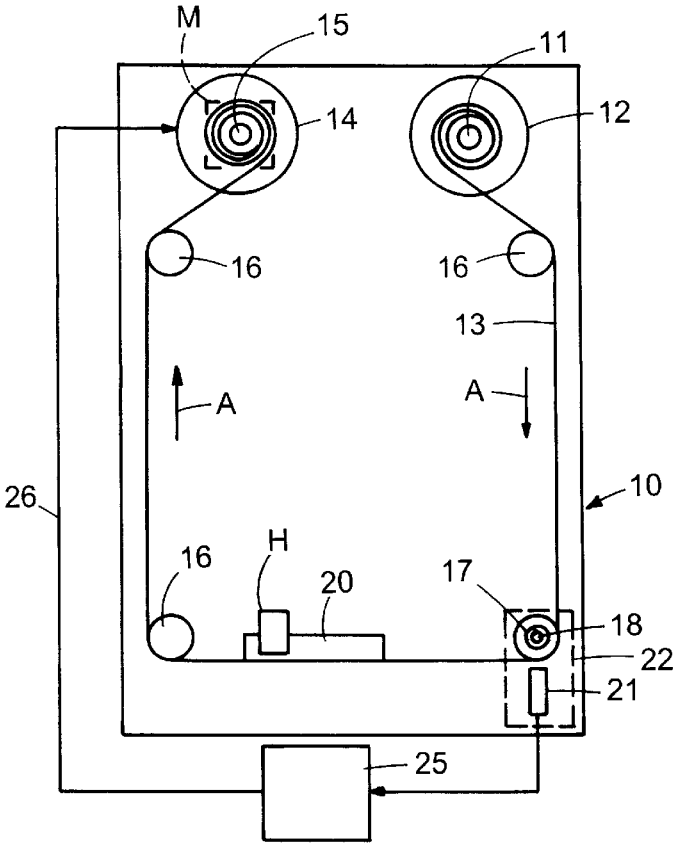
FIG. 1
FIG. 2
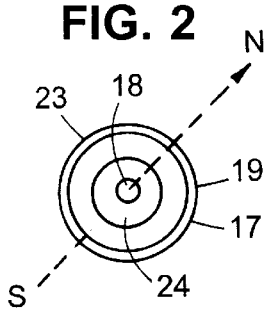
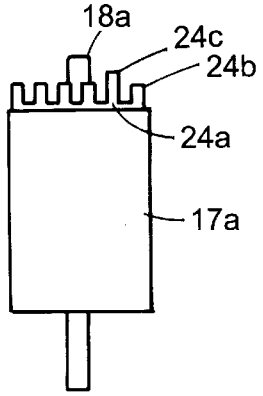
FIG. 3

METHOD OF CALIBRATING A RIBBON WINDING MECHANISM FOR A PRINTING APPARATUS

This is a continuation of International Patent Application No. PCT/GB96/00649, with an international filing date of Mar. 15, 1996, now pending.

This invention relates to a method of calibrating a ribbon winding mechanism for a printing apparatus, the mechanism being of the kind in which ribbon on a storage spool is fed along a path, for example past a printing station, onto a take-up spool.

The ribbon may for example be thermal transfer ribbon used in a thermal printing apparatus as described in detail in our previous published International patent application number WO94/26526, or an inked ribbon or any other ribbon used in printing or similar processes. In another example the ribbon may comprise a backing web carrying a plurality of labels which are removed from the web as the web is fed along the path between the storage and take-up spools.

It is desirable in many printing apparatus, to be able to advance the ribbon from the storage onto the take-up spool, in accurate incremental amounts. For example in a thermal printing apparatus the ribbon used is a expensive consumable and hence it is desirable to advance the ribbon a minimum amount between printing operations to save on wastage of ribbon.

Presently there are a number of methods utilised in a thermal printing apparatus for achieving winding of ribbon between printing operations. Such ribbon can be provided on a cassette which is removed when all the ribbon is used up, and another cassette containing a full ribbon storage spool is inserted into the apparatus.

One known method is achieving accurate ribbon winding, is to advance the ribbon through the path between the supply and take-up spools, by means of a drive roller assembly and to control the drive roller assembly.

An advantage of this method is that it drives the ribbon very accurately, independently of the supply and take-up spools and hence irrespective of ribbon diameter on the spools.

A disadvantage however is that the mechanism is complex, and requires components such as the drive roller etc. Hence it is relatively expensive in general terms. Furthermore, in printing apparatus where available space is highly constrained, in order to avoid reliability problems, a high standard of engineering is required which can further increase cost.

Another known method of achieving ribbon winding is by directly driving the take-up spool and controlling the amount of rotation of the take-up spool.

The advantages of this are:

1) despite space constraints if the winding mechanism is designed correctly, the mechanics of it can be relatively simple and reliable;

2) the simplicity means that the solution is low cost.

However this method has clear a disadvantage in that the system is open to operator intervention leading to ribbon advance errors. This is because the diameter of the take-up spool will increase as the ribbon is wound onto it.

The relationship between the effective increase in take-up spool diameter and the amount of rotation of the take-up spool can theoretically be calculated, and to an acceptable accuracy provided that the ribbon is of a generally constant thickness, and there being a generally constant ribbon tension. Further, by knowing the length of ribbon used, which may be calculated in a single use ribbon application, from knowing the length of ribbon used in each printing operation and the number of printing operations performed since the cassette was inserted, the growing diameter of the ribbon of the take-up spool can be compensated for by rotating the take-up spool less and less, to advance the ribbon the same amount in each subsequent printing operation.

The length of ribbon used where the ribbon is a so-called multi-pass or multi-strike ribbon or otherwise when the same length of ribbon is used to perform several prints, the length of ribbon used at any time may also be determined by simple means.

Furthermore, if an operator removes a roll or modifies the effective diameters of the spools by hand winding ribbon, which can often occur in a production run due to printer faults and ribbon breakage, then the method is wide open to errors.

If for example an operator intervenes, by fitting a new supply spool of ribbon, but does not reset the control system mechanism, the calculation performed may assume an effective re-starting diameter of the ribbon of the take-up spool which is nothing like the actual effective diameter, so that the amount of ribbon advanced will be significantly in error compared with what is required.

According to a first aspect of the invention we provide a method of calibrating a ribbon winding mechanism of a printing apparatus which is adapted to perform a printing operation in which at a printing station there is relative movement between a print head and a first length of the ribbon to transfer print medium from the first length of the ribbon onto a substrate and the ribbon is subsequently advanced a predetermined amount to present a second length of ribbon at the printing station for use in a further printing operation, the winding mechanism comprising a supply spool and a take-up spool and there being a ribbon path between the supply and take-up spools through the printing station, and a motive means to cause the ribbon to be moved along the ribbon feed path and wound onto the take-up spool, and a sensing means to sense movement of the ribbon as the take-up spool is rotated and to provide a signal to a control means in response, the method being characterised in that prior to performing the printing operation, the take-up spool is rotated a predetermined amount whilst the sensing means senses the resultant ribbon movement along the ribbon feed path, and the control means determines from the signal received from the sensing means the amount to rotate the take-up spool in the subsequent printing operation to advance the ribbon the predetermined amount.

Hence using the simpler mechanics of the known ribbon wind mechanism which operates according to the second prior art method described, in combination with a sensing means to sense ribbon movement e.g. along the path, a ribbon wind mechanism having the advantages of the mechanism which operates according to the second prior art method described, can be achieved which can easily be calibrated.

At least during calibration, the take-up spool may conveniently be driven by a stepper motor for example, so that the number of steps stepped by the motor can be controlled by the control means to rotate the take-up spool the predetermined amount.

The sensing means may comprise an idler roller of known diameter which is in contact with the ribbon as the ribbon is wound onto the take-up spool and is thus rotated as the ribbon moves, the method comprising determining the amount of rotation of the idler roller for the predetermined amount of rotation of the take-up spool so that rotation of the take-up spool can be related by the control means to the amount of ribbon movement.

In one arrangement, there is provided a magenetised element which is rotatable with and may be mounted on the idler roller and there is at least one magnetic sensor to sense movement of the magnetised element thus to determine the amount of rotation of the idler roller.

In another example, the amount of rotation of the idler roller may be sensed by an optical system which for example includes an optical element carried for rotation with the idler roller, and an optical sensor operable to sense when the optical element moves past the sensor.

In each case, the idler roller may be coated with a high friction material to ensure that there is no slippage between the ribbon and the roller. If desired, the idler roller may be mounted to rotate with a spindle which may carry the magnetic, optical or other element the movement of which is sensed by an appropriate sensor.

According to a second aspect of the invention we provide a printing apparatus including a control means for performing a calibration of a ribbon winding mechanism thereof according to the first aspect of the invention.

The printing apparatus may comprise an apparatus of the thermal transfer printing type, in which case the ribbon may comprise a thermally sensitive ribbon comprising a backing and ink deposited upon the backing, the ink being transferable by means of a thermal print head from the backing onto a substrate.

During a printing operation, the print head may be moveable relative to a stationary ribbon and substrate, or alternatively during printing, the print head may be stationary and the ribbon and substrate moved past the printing head, or the print head may move relative to a moving ribbon and substrate.

The invention will now be described with reference to the accompanying drawings in which:

FIG. 1 is a purely illustrative view of a ribbon winding mechanism which may be calibrated by a method in accordance with the invention;

FIG. 2 is a plan view of an idler roller of the mechanism of FIG. 1;

FIG. 3 is a side view of an alternative form of an idler roller which may be used in the mechanism of FIG. 1.

Referring to the drawings, a ribbon winding mechanism 10 comprises a ribbon supply spool 11 including a hub 12 around which ribbon 13 is wound. The mechanism 10 further comprises a ribbon take-up spool 14, having a hub 15 onto which the ribbon 13 is wound. Hence there is a ribbon path between the supply spool 11 and the take-up spool 14 around a plurality of simple idler rollers indicated at 16 to guide the ribbon 13, and an idler roller indicated at 17, of a sensing means 22, such that the ribbon path is through a printing station indicated at 20.

In one embodiment of the invention, the ribbon winding mechanism 10 is utilised in a printing apparatus in which the ribbon 13 comprises a thermally sensitive ribbon having a backing wed and ink deposited on the web.

During printing, relative movement occurs between a print head H at the printing station 20, and the ribbon 13 and individually energisable heating elements of the print head H cause ink to be deposited from the ribbon 13 onto an adjacent substrate.

The print head may be moveable relative to a stationary ribbon and substrate during printing, or else the ribbon and substrate may be moved relatively to a stationary print head. Further alternatively, the print head may be moved relative to a moving ribbon and substrate.

A fuller description of one such printing apparatus which operates according to these principles is contained in our co-pending International patent application number WO94/26526, or in our UK Patent 2289441.

During a printing operation, usually or between printing, the ribbon 13 is unwound from the supply spool 11, moved along the ribbon path and fed onto the take-up spool 14, by rotating the take-up spool 14 using an appropriated motive means M. One appropriate motive means would be a stepper motor, such that movements of the take-up spool 14, and hence the amount of ribbon 13 moved can accurately be controlled by a control means 25.

The idler roller 17 and an appropriate sensor system 21 together comprise a sensing means 22 which senses ribbon movement, in this example, along the ribbon path. The outer diameter of the idler roller 17 is an accurately known parameter and hence the amount of ribbon movement can be rotated to a given rotation of the take-up spool 14 by the control means 25.

The idler roller 17 is preferably carried on a spindle 18. In the arrangement shown in FIG. 2 there is an example of idler roller 17 which may be used. The idler roller 17 is coated with a coating 23 which is antislip coating to prevent slippage occurring between the ribbon 13 and the idler roller 17 when the ribbon 13 is moved. The outer diameter of the coated roller 17 is measured at the outside surface of the coating for optimum accuracy in the mechanism.

In the example of FIG. 2, the idler roller 17 is carried on a spindle 18 and may rotate relative to the spindle 18. On an end surface of the idler roller 17 there is provided a magnetic disc 24, which will have a north and south pole as indicated in FIG. 2.

Nearby roller 17, there is a magnetic sensor 21 which can monitor rotation of the idler roller 17 by determining when a north and/or south pole of the disc 24 passes the sensor 21. In another arrangement, a pair of magnetic sensors may be provided which, as the idler roller 17 rotates, gives two phase shifted sine waves, which, if the phase difference of which is signal processed at a high frequency by a control means 25 will give a very accurate measure of the rotational movement of the idler roller 17.

The sensor 21 or sensors provided an input signal to the control means 25 in response to ribbon movement particularly during calibration of the ribbon winding system as hereinafter described, so that in a subsequent printing operation the control means may provide a signal along line 26 to the stepper motor driving the take-up spool 24, to cause the stepper motor to step a calculated number of steps to achieve a desired amount of ribbon movement.

If desired, for each subsequent movement of ribbon 13, the control means 25 may determine by the sensor means 22, the amount of ribbon movement which has occurred for a given number of steps stepped by the stepper motor during the previous ribbon movement. Hence for each subsequent movement of the take-up spool, the number of steps stepped may be adjusted to ensure that the amount of ribbon movement will be, accurately, a desired amount.

Another arrangement, of idler roller 17*a* is shown in FIG. 2. Attached to the roller 17*a* is a gear 24*a* which has a plurality of teethe 26*b*. Such an idler roller 17*a* may be used in conjunction with an optical sensing system so that the number of teeth 25 passing for example an optical sensing element can be counted, so that again an accurate determination of the rotational movement of the driven roller 17*a* can be determined by knowing the external or outer diameter of the roller 17*a* and a signal fed to the control means 25. One tooth 24*c* may be bigger than the other teeth, as a check on the number of full rotations occurring.

It will be appreciated that in a printing apparatus such as described in our prior International patent application number WO94/26526 and our prior UK Patent 2289441, the ribbon 13 would be carried on spools 11 and 14 on a cassette which is inserted into the main printing apparatus. According to the invention, it is arranged such that upon the or each occasion when a ribbon cassette is inserted into the printing apparatus the stepper motor which drives the take-up spool 14 rotates the take-up spool a predetermined amount, i.e. the motor steps a given number of steps, to wind a portion of the ribbon onto the spool 14, whilst the corresponding amount of ribbon movement sensed by sensor 22 to provide an initial calibration. This rotation of the take-up spool may be a greater rotation than would be required to advance a desired amount of ribbon during a printing operation, for example and order of magnitude greater. If the ribbon is not provided on a cassette, this initial calibration needs to be performed each time the ribbon is rethreaded along the ribbon path, or otherwise attended to by an operator.

If desired, during normal operation of the apparatus, the control means 25 may be arranged to re-calibrate the apparatus at intervals.

In each case, once a calibration is performed, the amount of take-up spool 14 rotation required to feed a desired amount of ribbon along the ribbon feed path in a printing operation can be determined.

From then on, the apparatus 10 may be arranged to compensate for the growing diameter of ribbon on the take-up spool by rotating the take-up spool 14 progressively less for each ribbon advancement, so as to achieve advancement of generally the same amount of ribbon in each subsequent printing operation.

Such compensation may be achieved by the control means 25 monitoring the length of ribbon used, either from a signal from the sensing means 21, or preferably by calculating the amount of ribbon used from knowing the length of ribbon used in each printing operation and the number of printing operations performed since calibration. From knowing this and the ribbon thickness, the control means 25 will thus be able to calculate how the diameter of the ribbon on the take-up spool 24 will increase as ribbon is used, and thus compensate for this growing diameter.

Various modifications may be made without departing from the scope of the invention. For example, the sensing means described with reference to FIGS. 1 and 2 or FIGS. 1 and 3 are only examples of appropriate sensing means for sensing movement of the ribbon 13 as the take-up spool 14 is rotated. For example, a more sophisticated optical encoding system may be used to determine the amount of rotational movement of the idler roller 17.

It is not essential that there is provided a stepper motor to provide driving power to the take-up spool 14, but another motive means could instead be provided, such as a servo controlled motor, which allows for accurate control of the rotation of the take-up spool 14.

Although the invention has been described with reference to calibrating a ribbon winding mechanism 10 for a thermal printing apparatus, the invention may be applied to any other kind of printing apparatus, in which there is a ribbon winding mechanism for winding ribbon from a supply spool 11 onto a take-up spool 14 and where it is desired to advance the ribbon incrementally by accurate amounts.

It will be appreciated that the invention dies not preclude rewinding the ribbon 13 from the take-up spool 14 onto the supply spool 11 in an arrangement where for example it is desired to rewind ribbon onto the supply spool 11 for example to allow a particular length of ribbon repeatedly to be used for printing or to allow for use of multi-strike or multi-pass ribbons. The sensing means 22 may thus in normal use of the printing apparatus be used to provide a measure of the amount of ribbon movement in a direction opposite to that indicated by the arrows A in the drawing which is the normal direction for ribbon movement. In this event, of course the take-up spool 14 would perform the function of a supply spool, and the supply spool 11 would be performing the function of a take-up spool with there being a motive means which allows for the selective driving of the take-up and supply spools 14, 11.

The features disclosed in the forgoing description, or the following claims, or the accompanying drawings, expressed in their specific forms or in terms of a means for performing the disclosed function, or a method or process for attaining the disclosed result, as appropriate, may, separately or in any combination of such features, be utilised for realising the invention in diverse forms thereof.

We claim:

1. A method of calibrating a ribbon winding mechanism of a printing apparatus comprising:

providing a winding mechanism which is adapted to perform a printing operation in which there is relative movement at a printing station between a print head and a first length of a ribbon to transfer print medium from the first length of the ribbon onto a substrate and the ribbon is subsequently advanced a predetermined amount to present a second length of ribbon at the printing station for use in a further printing operation, said winding mechanism comprising:

a supply spool and a take-up spool, there being a ribbon path between the supply and take-up spools through the printing station;

a motive device to cause the ribbon to be moved along the ribbon feed path and wound onto the take-up spool;

a sensor to sense movement of the ribbon as the take-up spool is rotated; and a controller wherein the sensor provides a signal to the controller in response to the movement of the ribbon;

the method further comprising calibrating by:

rotating the take-up spool a predetermined amount whilst sensing with the sensor the resultant ribbon movement along the ribbon feed path, and determining with the controller from the signal received from the sensor the amount to rotate the take-up spool to advance the ribbon the predetermined amount after a subsequent printing operation.

2. A method according the claim 1 wherein the take-up spool is driven by a stepper motor such that the number of steps stepped by the motor is controlled by the control means to rotate the take-up spool the predetermined amount.

3. A method according to claim 1, wherein the sensor comprises an idler roller of known diameter which is in contact with the ribbon as the ribbon is wound onto the take-up spool and is thus rotated as the ribbon moves, the method comprising determining the amount of rotation of the idler roller for the predetermined amount of rotation of the take-up spool so that rotation of the take-up spool can be related by the contact to the amount of ribbon movement.

4. A method according to claim 3 wherein the sensor comprises a magenetised element which is rotatable with the idler roller, the method comprising sensing movement of the magnetised element with at least one magnetic sensor thus to determine the amount of rotation of the idler roller in response to the predetermined amount of rotation of the take-up spool.

5. A method according to claim 3 wherein the sensor comprises an optical element which is rotatable with the idler roller, the method comprising optically sensing when the optical element moves past an optical sensor.

6. A method according to claim 4 the idler roller is mounted to rotate with the spindle which carries the magnetised element.

7. A method according to claim 4 wherein the magnetised element is mounted on the idler roller.

8. A method according to claims 1–7, comprising repeating said calibration step to re-calibrate the apparatus prior to a subsequent printing operation, wherein during operation of the printing means the effective diameter of the ribbon on the take-up spool increases as ribbon is used up in printing operations and wound onto the take-up spool.

9. A method according to claim 1 wherein the printing apparatus comprises an apparatus of the thermal transfer printing type, and the ribbon being a thermally sensitive ribbon comprising a backing and ink deposited upon the backing, the ink being transferable by means of a thermal print head from the backing onto a substrate.

10. A printing apparatus comprising a printing station at which during a printing operation, there is relative movement between a print head and a first length of a ribbon during which print medium is transferred from the first length of the ribbon onto a substrate, and the ribbon is subsequently advanced a desired amount to present a second length of the ribbon at the printing station for use in a further printing operation, ribbon movement being achieved by a winding mechanism comprising a supply spool and a take-up spool with there being a ribbon path between the supply and take-up spools through the printing station, the winding mechanism further comprising a motive device to cause ribbon to be moved along the ribbon feed path and wound onto the take-up spool, there being a sensor to sense movement of the ribbon a the ribbon is wound onto the take-up spool and to provide a signal to a controller in response, wherein the controller is adapted, prior to a printing operation, to operate the motive device so that the take-up spool is rotated a predetermined amount whilst the sensor senses ribbon movement along the ribbon feed path, and to determine from the signal received from the sensor the amount to rotate the take-up spool to advance the ribbon the desired amount during advancement of the ribbon after printing in a subsequent printing operation.

11. A method according to claim 5 wherein the idler roller is mounted to rotate with the spindle which carries the optical element.

12. A method according to claim 5 wherein the optical element is mounted on the idler roller.

* * * * *